US005753042A

United States Patent [19]

Bauer

[11] Patent Number: 5,753,042

[45] Date of Patent: May 19, 1998

[54] FLEXIBLE SUPPORT FOR ELECTROSTATICALLY PAINTED PARTS

[75] Inventor: Richard D. Bauer, Clarklake, Mich.

[73] Assignee: Hi-Tech Flexible Products, Inc., Jackson, Mich.

[21] Appl. No.: 694,174

[22] Filed: Aug. 8, 1996

[51] Int. Cl.[6] ..... B05C 13/00

[52] U.S. Cl. ..... 118/504; 118/505; 118/621; 118/624; 118/630; 118/635

[58] Field of Search ..... 118/504, 505, 118/621, 624, 630, 635

[56] References Cited

U.S. PATENT DOCUMENTS

| | | | |
|---|---|---|---|
| 690,039 | 12/1901 | Smith . | |
| 2,324,568 | 7/1943 | Duggan . | |
| 2,328,203 | 8/1943 | Duggan . | |
| 2,359,977 | 10/1944 | Duggan . | |
| 2,371,859 | 3/1945 | Wallace . | |
| 2,553,724 | 5/1951 | Ransburg | 118/635 |
| 2,730,461 | 1/1956 | Vawter | 118/635 |
| 2,730,988 | 1/1956 | Starkey | 118/635 |
| 2,805,642 | 9/1957 | Tuttle et al. | 118/635 |
| 2,840,039 | 6/1958 | Darnell et al. . | |
| 3,113,037 | 12/1963 | Watanabe | 118/635 |
| 4,213,418 | 7/1980 | Oswald | 118/635 |
| 5,099,787 | 3/1992 | Powers | 118/635 |
| 5,270,085 | 12/1993 | Horiki et al. | 428/34.1 |
| 5,328,723 | 7/1994 | Horiki et al. . | |

*Primary Examiner*—Donald E. Czaja
*Assistant Examiner*—Michael P. Colaianni
*Attorney, Agent, or Firm*—Young & Basile, P.C.

[57] ABSTRACT

A support for parts being electrostatically coated or painted as mounted upon an electrically charged rack wherein the support is formed of a flexible material and includes a flexible electrical conductive portion engaging the rack and part permitting the part to be charged, and a flexible non-conductive portion frictionally engaging the part. The support may include a masking cover defined on either of the portions engaging and protecting the part from painting. The support may be formed of thermoset rubber material, thermoplastics, polyvinylchloride material, or the like.

15 Claims, 1 Drawing Sheet

FLEXIBLE SUPPORT FOR ELECTROSTATICALLY PAINTED PARTS

BACKGROUND OF THE INVENTION

1. Field of the Invention

The invention pertains to supports and masks for parts being electrostatically painted or similarly coated under electrical conditions.

2. Description of the Related Art

When painting or otherwise coating parts, it is known to protect those portions of the part which are not to be painted by a mask or similar protective structure as shown in U.S. Pat. Nos. 690,039; 2,324,568; 2,328,203; 2,371,859; 2,359,977; 2,840,039; 5,270,085 and 5,328,723. Such patents disclose various configurations of masks which are complementary to the part configuration, or otherwise capable of protecting the part from paint.

Today, much high quality painting is achieved by spray painting techniques wherein the parts being painted and the paint particles are electrostatically charged at opposite polarity so that the paint will be attracted to the part providing excellent paint coverage, and minimizing the amount of paint used in that overspray is largely eliminated. Parts being electrostatically spray painted are normally mounted upon a rack, especially small parts, and it is necessary that an electrical connection be maintained between the rack and the part if the part is to be electrostatically charged during painting. Considerable difficulty has been encountered in supporting the part upon the rack in a dependable electroconductive manner. For instance, the paint will build up upon the part support insulating the support from the rack and part. Also, as the parts may directly be placed upon the rack, the parts are susceptible to nicks and scratches, as well as contamination, and shadows will result from haphazard placing of the parts upon the rack.

OBJECTS OF THE INVENTION

It is an object of the invention to provide a support for parts being electrostatically painted and supported upon a charged rack wherein a dependable electrical connection will be maintained between the part and the rack during painting.

Another object of the invention is to provide a support for parts being electrostatically painted wherein the parts are supported in a flexible and "soft" manner prevent marring, nicking and scratching the part during painting.

An additional object of the invention is to provide a support for parts being electrostatically painted wherein portions of the part not to be painted may be masked by the support in a liquid-tight manner.

A further object of the invention is to provide a support for parts being electrostatically painted which prevents racking marks or shadows being defined on the parts due to an uneven application of paint.

Yet another object of the invention is to provide a support for parts being electrostatically painted wherein the parts are mounted upon an electrically charged rack in a consistent uniform manner and wherein improved painting characteristics are achieved while simultaneously protecting the part against damage during racking and painting.

SUMMARY OF THE INVENTION

The support for parts to be painted by an electrostatic painting processing in accord with the invention are preferably molded, or could be otherwise shaped, and are formed of a flexible material such as a thermoset rubber, thermoplastic, plastic, polyvinylchlorides, or could even be formed of a fabric material, or the like.

The part support includes an electroconductive portion which includes a hole, hangar or other means for attaching the conductive portion to the charged rack. Additionally, the conductive portion engages the part to be painted so that a continuous effective electrical contact is maintained between the rack and the part. Additionally, the part support includes a flexible non-conductive portion associated with the part being painted for supporting the part and maintaining the part in the desired orientation upon the rack, and reducing the cost of the support.

The non-conductive part supporting portion may include friction enhancing surfaces such as ribs or shoulders.

Also, it is often desirable to mask a portion of the part from the electrostatically paint charged wherein such portion of the part is desired not to be contaminated by the paint, and to this end, either the conductive portion, or the non-conductive portion, may constitute a cover or mask directly engaging the part and selectively protecting the part from paint.

In an embodiment of the invention, the part support includes a non-conductive flexible portion of a circular configuration having an annular lip which engages the part in a fluid-tight manner so as to mask that portion of the part over which the cover is superimposed.

Preferably, the part support is formed of a thermoset rubber, thermoplastic or similar synthetic plastic material, and the conductive portion of the part support usually includes a sufficient content of carbon to render the normally electrically insulative material electrically conductive. Of course, the impregnation of carbon within the conductive portion of the part support renders this portion of the part support relatively expensive, but the conductive portion will remain flexible and accommodate itself to the part configuration. The non-conductive portion of the part support is not impregnated with the carbon and is of a lower cost. Accordingly, from a cost standpoint, it is desirable to minimize the volume of the conductive portion of the part support, but the conductive portion must be sufficient to maintain the desired electrical continuity between the part and the rack.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENTS

Figure 1:
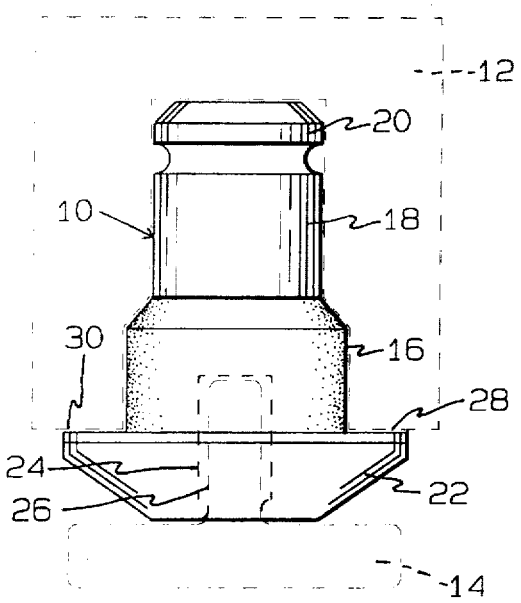
FIG. 1 is an elevational view of a part support in accord with the invention wherein a masking portion of the body support is non-conductive.

With reference to FIG. 1, a support member 10 is employed to support a part 12 represented by dotted lines in a schematic manner upon a rack 14 also represented by dotted lines in a schematic manner. The purpose of the support member 10 is to support the part 12 on the rack 14 in such a manner as to permit electrostatic painting of the part 12 as it passes through a paint booth upon a conveyor, or is manually painted. Normally, a plurality of parts 12 will be mounted upon the rack 14, and the parts will be maintained in relatively close relationship to each other.

The member 10 includes a conductive portion 16, stipple shaded, of a cylindrical configuration which corresponds to a hole within the part 12. The portion 16 is formed of an electrically conductive material, and is also flexible, as to accommodate itself readily within the part 12. The member portion 18 is of a smaller diameter than the portion 16 and is formed of a non-conductive flexible material and includes an annular shoulder 20 which also engages the bore within the part 12.

The support member 10 also includes a base member or cover member 22 having an axial hole 24 defined therein, the hole 24 also extending into the portion 16, and the rack pin 26 is received within the hole 24 for properly maintaining the support member 10 upon the rack 14.

The diameter of the pin 26 is close enough to the diameter of the bore within the portion 16 to establish an effective electrical contact between these points. The cover 22 includes a radial shoulder 28 which closely abuts against the end 30 of the part 12, and the engagement of the shoulder 28 and part end 30 will cover or shield the engaging portion of the part 12 preventing this portion of the part from being painted.

Preferably, the support member 10 is formed by a molding operation, and will usually be formed of a thermoset rubber, thermoplastic materials, plastic materials, polyvinylchlorides, or fabric of a relatively rigid nature. Preferably, the portions 16, 18 and 22 are integrally bonded together so as not to permit separation. The portion 16 will be rendered electrically conductive by a high content of carbon within the composition of the portion 16.

In the embodiment of FIG. 1, only the portion 22 will be exposed to the paint, and it will be appreciated that the support member 10 described above meets the objectives of the invention.

Figure 2:
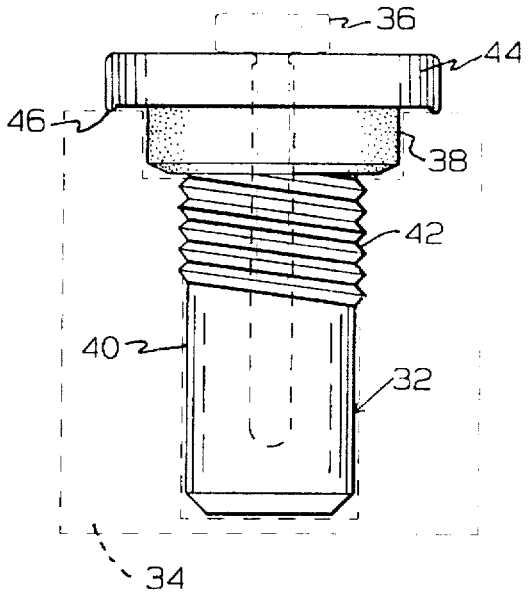
FIG. 2 is another embodiment of a part support in accord with the invention utilizing a non-conductive mask cover having a lip to insure a fluid-tight relationship with the part.

In FIG. 2, another embodiment of the inventive concepts is shown. The part support member 32 is received within the bore of the part 34, and the member 32 is mounted upon the pin of the rack 36. The cylindrical portion 38 of the member 32 is of the electrical conductive type, while the lower portion 40 is non-conductive and is closely received within a complementary hole within the part 34. To increase the frictional contact between the part 34 and the member 32, portion 40 is provided with a plurality of ribs 42, which may either be helical or parallel to each other. Because the ribs 42 are formed of the flexible material of portion 40, they are capable of sufficient deformation as to be closely snugly received within the coaxial hole within the part 34.

The member 32 includes a cylindrical dielectric cover 44 having a downwardly extending annular lip 46. The lip 46 sealingly engages the top of the part 34 so as to form a liquid-tight connection between the cover 44 and the part 34 whereby the cover 44 will function as a cover or mask for the upper region of the part 34.

As the rack 36 will be electrically charged, its interconnected electrical relationship with the portion 38 permits the part 34 to be electrically charged to attract spray paint having particles suitably charged.

Figure 3:
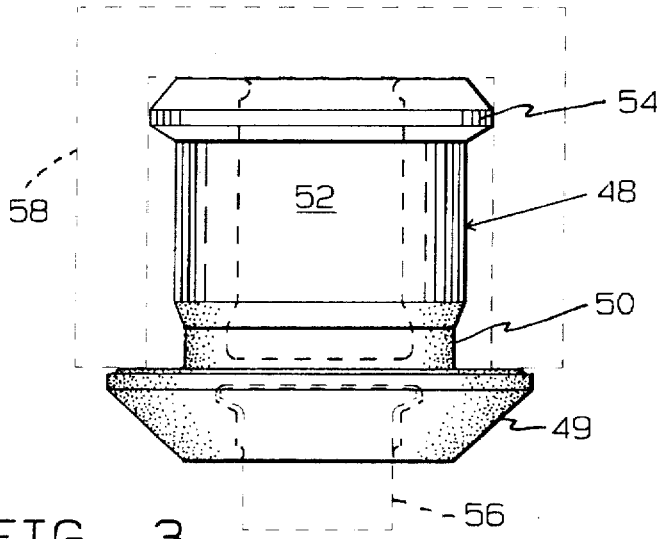
FIG. 3 is an elevational view of another embodiment of a part support in accord with the invention wherein the conductive portion functions as a mask.

In the embodiment of FIG. 3, the part supporting member 48 includes a conductive portion 49 which constitutes a cover for engaging the lower edge of the part, and the conductive portion includes a reduced diameter portion 50. The cylindrical portion 52 of the member 48 is non-conductive and includes an annular shoulder 54 which is firmly received within the bore of the part. The rack pin 56 is received within a complemental recess defined in the portion 49, and the part 58 includes a bore snugly receiving the shoulder 54. In the embodiment of FIG. 3, the diameter of the portion 49 is significantly larger than the diameter in the part 58 and portion 49 will serve as a cover or mask for the circular area surrounding the opening in the part 58, as well as the electrical contact with part 58.

Figure 4:
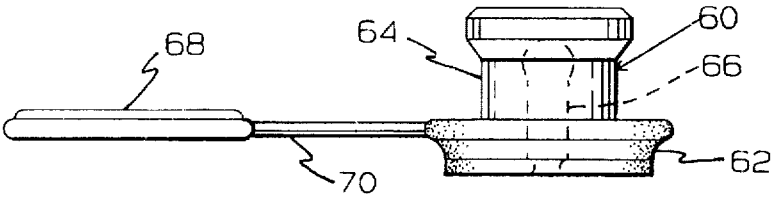
FIG. 4 illustrates yet another embodiment of the invention wherein the part support includes a flexible neck supporting a non-conductive portion capable of masking orifices in the part being painted.

In FIG. 4, the part supporting member 60 includes a conductive portion 62 and a non-conductive portion 64 adapted to be received within the bore of a part, not shown. The member 60 is provided with a coaxial hole 66 and the conductive portion 62 will serve as a mask to shield the portion of the part, not shown, into which the portion 64 is inserted. A cover 68 may be employed to mask an opening in the part with which member 60 is utilized, and the cover 68 is attached to the portion 62 by a flexible hinge 70. Thus, in the embodiment of FIG. 4, resilient masking members may be interconnected by a flexible hinge or web preventing the misplacement of the small cover 68. The bonding of the non-conductive and conductive portions of the part support members as described above renders a supporting member for electrostatically painted parts which is capable of long life, and which prevents nicks and scratches to the parts. Because of the flexibility of the material of both the non-conductive and conductive portions of the part support member, the parts will not be damaged or scratched, and as the conductive portion of the part supporting member not exposed to the paint environment establishes a continuous electrical connection with the part being painted, dependable and high quality part covering is achievable.

While the preferred embodiment of the invention as illustrated and described above shows a part support member having both conductive and non-conductive portions, it is within the scope of the invention to form the entire part support member of a flexible conductive material. With such a construction, all of the advantages disclosed above, except cost, would be attainable and available to the user. Additionally, it is to be understood that while the part supports utilizing the inventive concepts are primarily used in painting applications, the part supports may also be employed with parts being plated or otherwise coated.

The configuration of the part supports is primarily dictated by the configuration of the part being supported, and the support is not limited to a cylindrical configuration. Many different shapes are available to the part support designer, as needed. Also, it will be understood that the inventive concepts may be employed with support members which mask the outside of the part as well as the inside thereof.

It is appreciated that various modifications to the inventive concepts may be apparent to those skilled in the art without departing from the spirit and scope of the invention.

I claim:

1. A flexible support for mounting parts to be electrostatically painted upon an electrically charged rack comprising, in combination, a first flexible non-metallic electrically conductive portion and a second flexible non-metallic deformable portion of non-electrically conductive material, said first and second portions being integrally bonded, rack and part engaging means defined on said first portion to establish electrical conductivity between the rack and the part, said second portion engaging and supporting the part during painting.

2. In a flexible support as in claim 1, said second portion including friction enhancing means engaging the part to be painted.

3. In a flexible support as in claim 1, a part mask defined on at least one of said portions integral with said one portion adapted to engage the part being painted to shield the part from painting.

4. In a flexible support as in claim 3, said part mask being defined on said second portion.

5. In a flexible support as in claim 3, said part mask including a cover and a lip, said lip engaging the part to be painted.

6. In a flexible support as in claim 1, said first and second portions being formed of a rubber material.

7. In a flexible support as in claim 1, said first and second portions being formed of thermoplastic material.

8. In a flexible support as in claim 1, said first and second portions being formed of polyvinylchloride material.

9. A flexible support for mounting parts to be electrostatically coated upon an electrically charged rack comprising, in combination, a flexible deformable body having rack and part engaging means defined thereon, said body being formed of a flexible non-metallic electrically conductive material and coating shield portions defined on said body.

10. A flexible support for mounting parts having a bore defined therein to be electrostatically painted upon an electrically charged rack comprising, in combination, a first flexible non-metallic electrically conductive portion and a second flexible non-metallic deformable portion of non-electrically conductive material, said second portion adapted to be closely received within the part bore, said first and second portions being integrally bonded, rack and part engaging means defined on said first portion to establish electrical conductivity between the rack and the part, said second portion engaging and supporting the part during painting.

11. In a flexible support as in claim 10, said second portion including friction enhancing means engaging the part to be painted.

12. In a flexible support as in claim 10, a part mask defined on at least one of said portions integral with said one portion adapted to engage the part being painted to shield the part from painting.

13. In a flexible support as in claim 10, said first and second portions being formed of a rubber material.

14. In a flexible support as in claim 10, said first and second portions being formed of thermoplastic material.

15. In a flexible support as in claim 10, said first and second portions being formed of polyvinylchloride material.

* * * * *